US006595348B1

(12) United States Patent
Grasswill et al.

(10) Patent No.: US 6,595,348 B1
(45) Date of Patent: Jul. 22, 2003

(54) DEVICE FOR CONVEYING MAIL USING ELASTICALLY DEFORMABLE ELASTOMER WHEELS

(75) Inventors: Vincent Grasswill, Montelier (FR); Robert Vivant, Chabeuil (FR); Fabrice Darrou, Chabeuil (FR)

(73) Assignee: Solystic, Gentilly Cedex (FR)

( * ) Notice: Subject to any disclaimer, the term of this patent is extended or adjusted under 35 U.S.C. 154(b) by 0 days.

(21) Appl. No.: 10/009,927

(22) PCT Filed: Jun. 7, 2000

(86) PCT No.: PCT/EP00/05288

§ 371 (c)(1),
(2), (4) Date: Mar. 11, 2002

(87) PCT Pub. No.: WO00/76893

PCT Pub. Date: Dec. 21, 2000

(30) Foreign Application Priority Data

Jun. 10, 1999 (FR) ..... 99 07316

(51) Int. Cl.[7] ..... B65G 15/14
(52) U.S. Cl. ..... 198/604; 198/626.1
(58) Field of Search ..... 198/604, 606, 198/608, 626.1, 626.3, 626.4, 625.5; 271/4, 149, 150, 272, 274

(56) References Cited

U.S. PATENT DOCUMENTS 3,951,257 A 4/1976 Storace et al.
4,523,674 A 6/1985 Haugen et al.
5,261,859 A 11/1993 Deemer et al.
5,701,990 A * 12/1997 Novar et al. ..... 198/604
5,890,581 A * 4/1999 Oppliger et al. ..... 198/604 X
6,450,323 B1 * 9/2002 Agier et al. ..... 148/626.1

FOREIGN PATENT DOCUMENTS

FR 2720535 12/1995

* cited by examiner

*Primary Examiner*—James R. Bidwell
(74) *Attorney, Agent, or Firm*—Pitney, Hardin, Kipp & Szuch LLP

(57) ABSTRACT

The device for the high-speed conveying of post envelopes (2A, 2B) comprises a fixed sole plate (11) extending along the path which the conveyed envelopes follow and along which the envelopes, standing on edge and arranged in series, glide, a motorized endless reference belt (12) stretched along one side of the sole plate, a motorized endless press belt (14) stretched along the other side of the sole plate, and a series of elastically deformable elastomer wheels (16) for elastically pressing against the reference belt in such a way as to grip the envelopes arranged on the sole plate between the reference belt and the press belt. The wheels (16) each have a hub mounted to rotate on a stationary spindle, and an annular tread strip in contact with the press belt, the hub and the annular tread strip of each wheel being connected by elastically deformable circular-arc-shaped fins. The two ends of each fin, which are for connection to the hub and to the annular tread strip of the wheel, lie on a radius of the wheel.

7 Claims, 3 Drawing Sheets

DEVICE FOR CONVEYING MAIL USING ELASTICALLY DEFORMABLE ELASTOMER WHEELS

The invention relates to a device for the high-speed conveying of flat objects, comprising a fixed sole plate extending along the path which the conveyed flat objects follow and along which the flat objects, standing on edge and arranged in series, glide, a motorized endless reference belt stretched along one side of the sole plate, a motorized endless press belt stretched along the other side of the sole plate, and means for elastically pressing the press belt against the reference belt in such a way as to grip the flat objects arranged on the sole plate between the reference belt and the press belt. The invention relates more specifically to a unit for conveying post envelopes in series edge-on between a destacking unit and a sorting unit of a machine for processing mail.

BACKGROUND OF THE INVENTION

Postal processing machines have to be designed to be able to accept a broad range of postal items. More specifically, they have to be designed to take flat rectangular envelopes the thickness of which varies between 0.15 and 32 millimeters whereas the length and width of these envelopes can vary respectively between 14 and 40 centimeters and between 9 and 30 centimeters. Hitherto, in units for conveying post envelopes in series edge-on, the motorized reference belt has been a fixed backing belt, conventionally mounted on a collection of pulleys of stationary vertical spindle, and the press belt has been pressed against the reference belt by pulleys with a mobile rotation spindle, mounted on arms which have been returned elastically by springs. As the envelopes in series edge-on between the two belts, namely the reference belt and the press belt, are moved along by friction, it is essential that the press belt be pressed firmly against the reference belt on each side of each envelope regardless of its thickness so as to guarantee that the envelopes will be moved along at uniform speed maintaining a constant spacing between consecutive envelopes from the entry to the exit of the conveying unit. As two consecutive envelopes moved along in the conveying unit at a speed in excess of 3 meters per second may have thicknesses which vary between 0.15 and 32 millimeters, it is essential that the means used to keep the press belt pressed against the reference belt have positional-return dynamics designed accordingly. Now, it has become apparent that the spring-retum of a pulley customarily used to press the press belt against the reference belt is unable to obtain optimum positional-retum of the pulley for all extreme variations in thickness of post envelopes. It then follows that the post envelopes arranged in series in the conveying unit have a speed of travel that fluctuates and results in variations in the spacing between consecutive envelopes in the conveying unit. This variation in the spacing between consecutive envelopes leads to disruptions at the character-recognition-address processing unit which may be installed on the path followed by the conveyed post envelopes. Finally, the rotary arms on which the pulleys are mounted require constant and expensive maintenance because it is essential to anticipate their seizure in order to prevent blockages at the exit from the conveying unit.

SUMMARY OF THE INVENTION

The object of the invention is therefore to overcome the aforementioned drawbacks of the state of the art and the invention therefore relates to a device for the high-speed conveying of flat objects, particularly post envelopes, comprising a fixed sole plate extending along the path which the conveyed flat objects follow and along which the flat objects, standing on edge and arranged in series, glide, a motorized endless reference belt stretched along one side of the sole plate, a motorized endless press belt stretched along the other side of the sole plate, and means for elastically pressing the press belt against the reference belt in such a way as to grip the flat objects arranged on the sole plate between the reference belt and the press belt, wherein said means consist of a series of elastomer wheels aligned along said other side of the sole plate, each wheel having a hub mounted to rotate on a stationary spindle, and an annular tread strip in contact with the press belt, the hub and the annular tread strip of each wheel being connected by elastically deformable circular-arc-shaped fins, the two ends of each fin, which are for connection to the hub and to the annular tread strip of the wheel, lying on a radius of the wheel.

Each elastomer wheel with elastically deformable fins is a large-diameter wheel allowing sufficient deformation to absorb the variations in thickness up to 40 millimeters with an appreciably constant compression force. The special profile of the fins, in the shape of arcs of a circle, with points of attachment located on the radius of the wheel, allows the elastomer to work along the entire length of the fins when the wheel is compressed without creating any stress-concentration zones, thus contributing to extending the life of the wheel.

BRIEF DESCRIPTION OF THE DRAWINGS

Other features and advantages of the invention will become better apparent from reading the description which follows, and which is illustrated by the drawings.

DETAILED DESCRIPTION OF THE PREFERRED EMBODIMENTS

Figure 1:
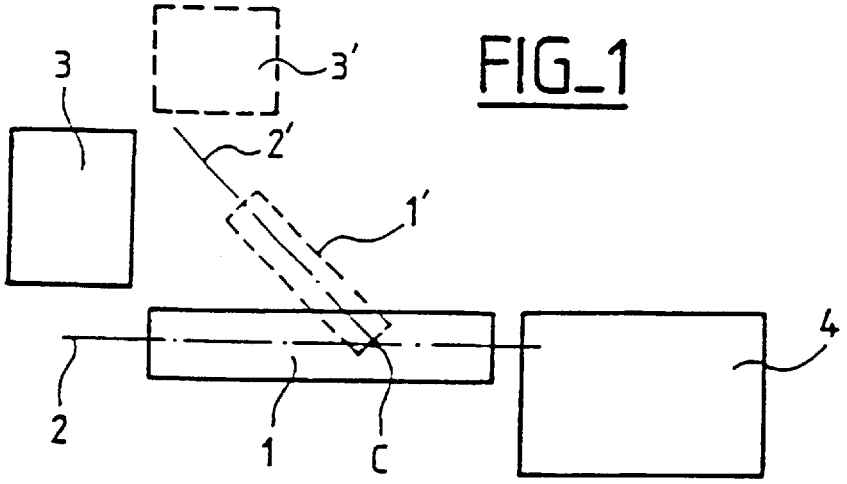
FIG. 1 is a very diagrammatic synoptic of a machine for processing mail including a device for conveying envelopes.

In FIG. 1, the device 1 according to the invention, for conveying flat objects of rectangular appearance and variable thickness, particularly post envelopes, is more particularly intended to move each envelope 2, arranged in series, along between the exit of a destacking unit 3 and the entry of a sorting unit 4. This conveying device moves the envelopes in series and edge-on, that is to say in a vertical position on the height or the width, at high speed between the two units 3 and 4. FIG. 1, illustrates in dotted line one alternative form of a conveying device according to the invention comprising two inlets, the second inlet being fed with envelopes 2' arranged in series by another destacker 3' and therefore two conveying paths 1, 1' which converge at a point of convergence C and which feed into a third conveying path located downstream of the two paths 1 and 1' and which feeds into the entry of the sorting unit 4.

Figure 2:
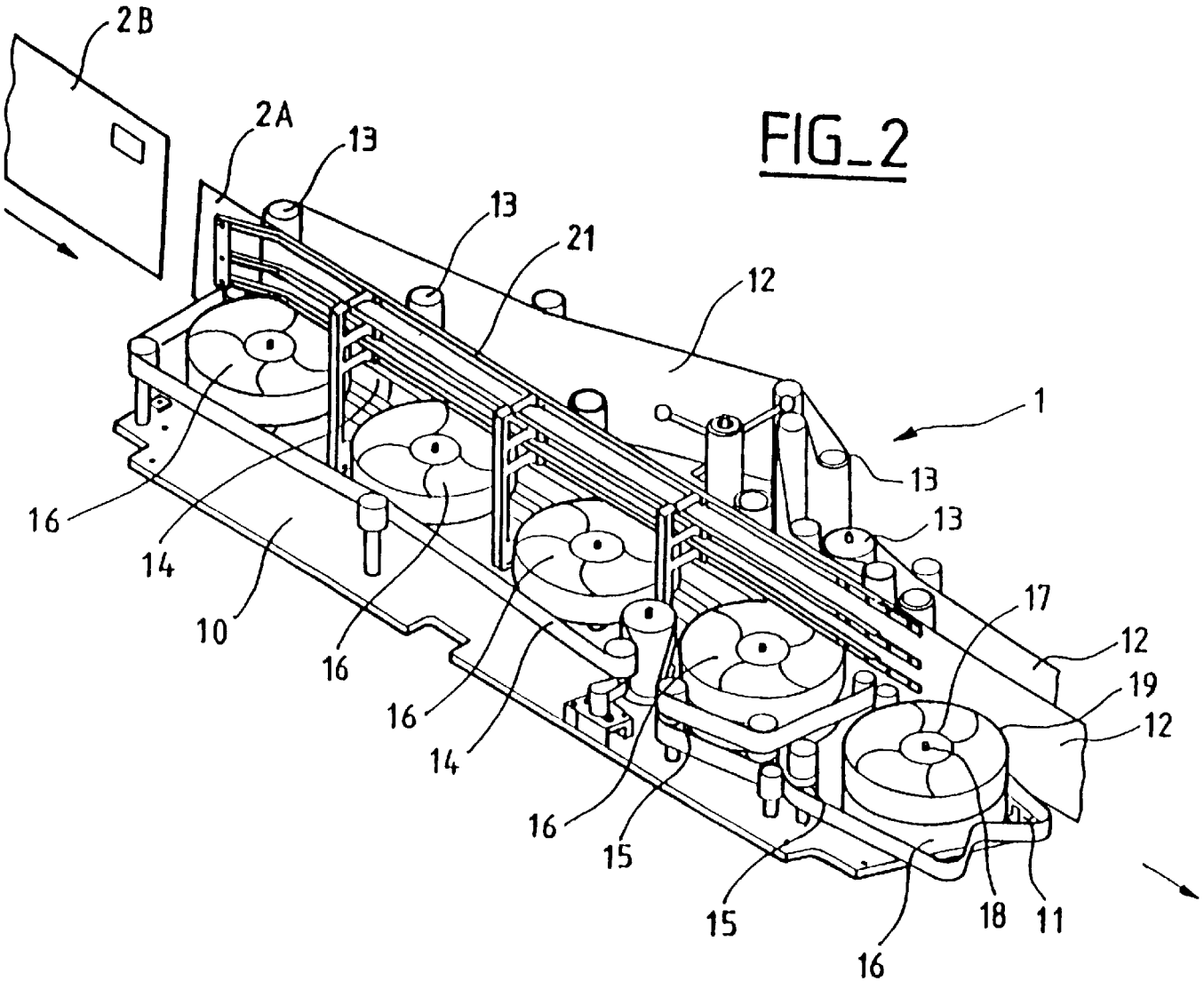
FIG. 2 is a perspective view of one embodiment of a device for conveying post envelopes with just one conveying path.

FIG. 2 illustrates one embodiment of a conveying device 1 according to the invention with just one conveying path. This device is mounted on a horizontal mounting plate 10. It comprises a sole plate 11 forming a kind of channel section which extends along the conveying path followed by the post envelopes and on which these glide, edge-on and in series. Two envelopes 2A and 2B arranged in series and edge-on are illustrated in FIG. 2 with arrows indicating the direction in which these are introduced into and leave the conveying device 1. The device also comprises a motorized endless fixed backing reference belt 12 which is stretched along one side of the sole plate 11 and engaged over a series of free or drive pulleys such as 13. The reference belt 12 is relatively broad (of the order of 20 centimeters) because it acts as a zone against which the envelopes rest. The device 1 also comprises a motorized endless press belt 14 which is stretched along the other side of the sole plate 11 and engaged over free or drive pulleys 15 and also over a series of elastically deformable elastomer wheels 16 aligned along this other side of the sole plate. The press belt 14 is not as broad as the reference belt (about 4 centimeters) and is used to press the envelopes against the reference belt while they are being conveyed.

As visible in FIG. 2, the press belt 14 is engaged over the series of elastomer wheels 16 facing the reference belt 12 and the wheels 16 are designed to press the press belt against the reference belt so that the envelopes such as 2A or 2B are gripped between these two belts 12 and 14.

Each wheel 16 is made of an elastomer, for example polyurethane, and is elastically deformable in a radial direction to follow the variations in thickness of the envelopes being conveyed between the two belts 12 and 14. The wheels 16 of the device 1 shown in FIG. 2 all have a stationary vertical rotation spindle and the variations in thickness of the envelopes such as A and 2B are absorbed by the elastic radial deformation of the wheels 16.

Figure 4:
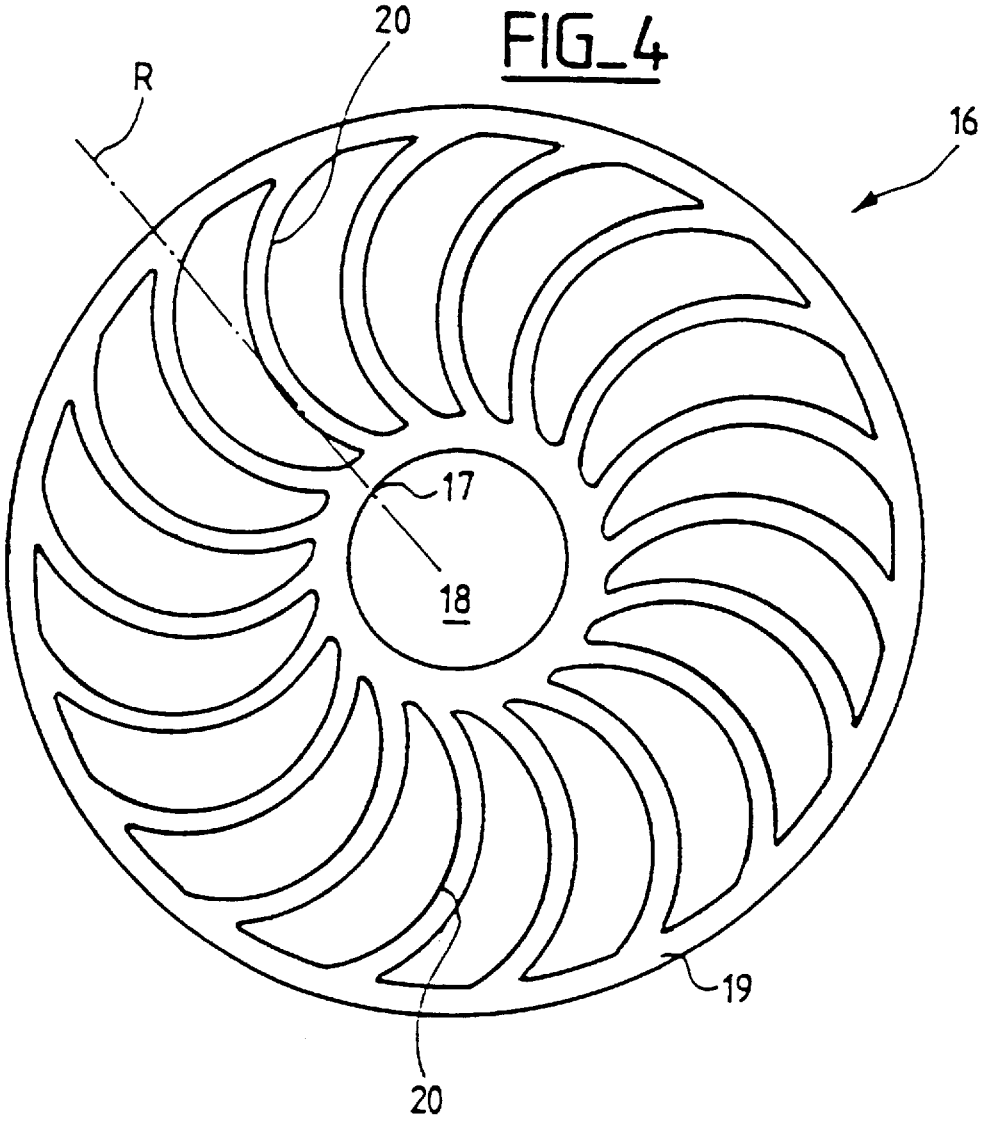
FIG. 4 is a very diagrammatic plan view of an elastomer wheel with elastically deformable fins according to the invention, which is used in the devices shown in FIGS. 2 and 3.

FIG. 4 shows, in greater detail, one embodiment, according to the invention, of an elastically deformable elastomer wheel 16. This wheel has a hub 17 which is intended to be mounted to rotate on a stationary spindle 18 on the mounting plate 10 and an annular tread strip 19 intended to be in contact with the belt 14. The elastomer hub 17 and the elastomer annular tread strip of the wheel 16 are connected by elastomer fins 20 in the shape of arcs of circles and which are elastically deformable. The two ends of each fin 20, which ends are for connection to the hub and to the annular tread strip of the wheel, lie on a radius R of the wheel, allowing the wheel to be compressed elastically in the radial direction without fin fatigue and with a maximum amplitude. In the example of the envelope conveyor of FIG. 2, the wheels 16 have a diameter of about 25 centimeters and a thickness of the order of 5 centimeters. A stationary guide 21 is mounted along the sole plate 11 on the same side as the wheels 16 and some distance from the reference belt 12, to act also as a zone against which the conveyed envelopes can rest.

When an envelope such as 2A passes past a wheel 16, the latter moves back in the face of the envelope by elastic radial deformation. Once the envelope has passed, the wheel returns to its position of rest to press the press belt 14 against the reference belt behind this envelope. Tests have been performed with wheel whose hardness in terms of deformation is about 55 shore. It has been found that these wheels have excellent durability and hold the envelopes very firmly between the two belts 12 and 14 throughout the entire range of sizes of post envelopes to be processed.

Figure 3:
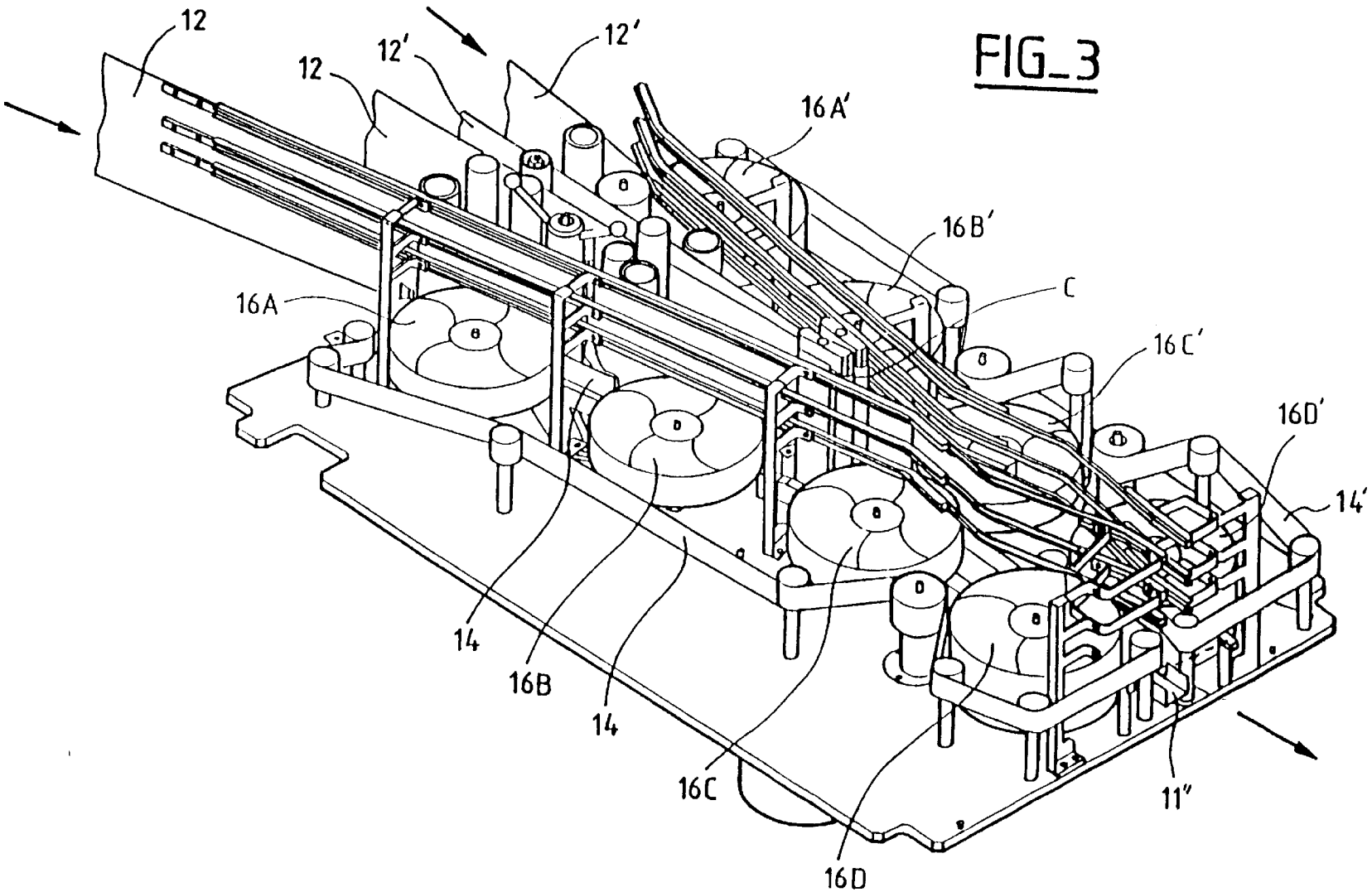
FIG. 3 is a perspective view of one embodiment of a device for conveying post envelopes with two conveying paths which converge one towards the other.

FIG. 3 shows another embodiment of a conveying device according to the invention. In this device, envelopes are conveyed in series, edge-on, along a first conveying path between a first reference belt 12 and a first press belt 14 pressed against the reference belt 12 by a first series of elastomer wheels 16A, 16B with stationary rotation spindles. Other envelopes are conveyed in series, edge-on, along a second conveying path between a second reference belt 12' and a second press belt 14' pressed against the reference belt 12' by a second series of elastomer wheels 16A', 16B' with stationary rotation spindles.

As visible in FIG. 3, the first conveying path converges towards the second conveying path at a point of convergence C downstream of which there is a third conveying path along which the envelopes leaving the first and second conveying paths are conveyed in series and edge-on. On this third conveying path, the envelopes are conveyed between two parallel rows of elastomer wheels with stationary rotation spindles, in this instance two rows of two wheels 16C, 16D and 16C', 16D' respectively, the two rows being arranged parallel to each other on each side of a sole plate 11". It can be seen in FIG. 3 that the wheels located on one side of the sole plate 11" are placed exactly facing the wheels located on the other side of the sole plate 11". Downstream of the point of convergence C, the envelopes arrive at a relatively wide transfer zone with no reference belt and the envelopes are gripped only between the press belts 14 and 14' engaged respectively over the wheels 16C, 16D and 16C', 16D', these press belts being common, respectively, to the first conveying path and to the second conveying path. Tests have shown the benefit of providing wheels 16C and 16C' located on the upstream side of the third conveying path with a hardness in terms of deformation which is greater than that of the wheels 16A, 16B and 16A', 16B' of the first and second conveying paths. This difference in hardness makes it possible to compensate for the greater force exerted by the belts 14 and 14' on the wheels 16C and 16C' in the zone of the point of convergence C where the belts are diverted. These tests have been performed with wheels 16C and 16C' which have a hardness in terms of deformation of about 65 shore, and wheels 16A, 16B, 16A', 16B' with a hardness in terms of deformation of the order of 55 shore. Furthermore, it is beneficial to be able to rejuggle each envelope as it leaves the third conveying path, in the absence of a fixed backing reference belt, before it enters the sorting unit. This rejuggling is performed using an arrangement whereby the wheels 16D, 16D' located on the downstream side of the third conveying path on each side of the sole plate 11" have different hardnesses in terms of deformation. What this means is that the wheel of greater hardness located on one side of the sole plate 11" positions each envelope with a constant lateral juggling reference which eliminates the risk of the envelopes becoming blocked as they enter the sorting unit. Conclusive tests have been performed with a wheel 16D with a hardness of 65 shore and a wheel 16D' with a hardness of 55 shore.

Of course, the elastically deformable elastomer wheels 16 in FIG. 2 and 16A to 16D' in FIG. 3 all have circular-arc-shaped fins, whose points of attachment to the hub and to the annular tread strip are aligned along the radius of the wheel as shown in FIG. 4.

These elastically deformable elastomer wheels with stationary rotation spindles reduce the need for maintenance of a conveyor placed between the destacking unit and the sorting unit in a machine for processing mail. They are easy to install and very reliable, which plays a part in improving the performance of such a machine.

What is claimed is:

1. A device for the high-speed conveying of flat objects, particularly post envelopes, comprising a fixed sole plate extending along the path which the conveyed flat objects follow and along which the flat objects, standing on edge and arranged in series, glide, a motorized endless reference belt stretched along one side of the sole plate, a motorized endless press belt stretched along the other side of the sole plate, and means for elastically pressing the press belt against the reference belt in such a way as to grip the flat objects arranged on the sole plate between the reference belt and the press belt, wherein said means includes a series of elastomer wheels aligned along said other side of the sole plate, each wheel having a hub mounted to rotate on a stationary spindle, and an annular tread strip in contact with the press belt, the hub and the annular tread strip of each wheel being connected by elastically deformable circular-arc-shaped fins, the two ends of each fin, which ends are for connection to the hub and to the annular tread strip of the wheel, being on a radius of the wheel.

2. The device as claimed in claim 1, in which first flat objects are conveyed in series, edge-on, along a first conveying path between a first reference belt and a first press belt pressed against the first reference belt by a first series of elastomer wheels with stationary rotation spindles, second flat objects are conveyed in series, edge-on, along a second conveying path between a second reference belt and a second press belt pressed against the second reference belt by a second series of elastomer wheels with stationary rotation spindles, the first conveying path converging towards the second conveying path, and in which the flat objects leaving the first and second conveying path are conveyed in series and edge-on along a third conveying path between two parallel rows of elastomer wheels with stationary rotation spindles.

3. The device as claimed in claim 2, in which the elastomer wheels of the third conveying path comprise elastomer wheels arranged on the upstream side of the third conveying path and elastomer wheels arranged on the downstream side of the third conveying path and in which the elastomer wheels arranged on the upstream side of the third conveying path on each of the rows of wheels have the same hardness in terms of deformation, in which the elastomer wheels of the first conveying path have hardness in terms of deformation which is the same as that of the elastomer wheels of the second conveying path, and in which the elastomer wheels arranged on the upstream side of the third conveying path have a hardness in terms of deformation which is greater than that of the elastomer wheels of the first and second conveying paths.

4. The device as claimed in claim 3, in which the elastomer wheels arranged on the downstream side of the third conveying path on one of the two rows of wheels have a hardness in terms of deformation which differs from that of the wheels arranged on the downstream side of the third conveying path on the other row of wheels.

5. The device as claimed in claim 3, in which the elastomer wheels of the first and second conveying paths have a hardness in terms of deformation of about 55 shore and the wheels arranged on the upstream side of the third conveying path have a hardness of about 65 shore.

6. The device as claimed in claim 4, in which the elastomer wheels arranged on the downstream side of the third conveying path on one row of wheels have a hardness in terms of deformation of about 65 shore and on the other row of wheels a hardness in terms of deformation of about 55 shore.

7. An elastically deformable elastomer wheel for conveying flat objects comprising an elastomer hub intended to be mounted to rotate on a stationary spindle, and an elastomer annular tread strip connected to said hub by elastically deformable elastomer fins, wherein each fin has a shape of arc of circle with two ends for connection to said hub and to said strip which are lying on a radius of said wheel.

* * * * *